United States Patent [19]

Hucknall

[11] 4,377,940

[45] Mar. 29, 1983

[54] IMPRESSION-RESISTANT LOCK

[76] Inventor: Richard Hucknall, 3 Fairview Ave., Great Neck, N.Y. 11023

[21] Appl. No.: 192,458

[22] Filed: Sep. 30, 1980

[51] Int. Cl.[3] ..... E05B 15/14; E05B 27/02

[52] U.S. Cl. ..... 70/364 A; 70/378; 70/419

[58] Field of Search ..... 70/364 R, 364 A, 421, 70/419, 416, 378, 376

[56] References Cited

U.S. PATENT DOCUMENTS

| | | | |
|---|---|---|---|
| 1,965,889 | 7/1934 | Fitzgerald | 70/419 |
| 2,059,129 | 10/1936 | Maxwell | 70/378 |
| 2,426,104 | 8/1947 | Johnstone | 70/421 |
| 3,035,433 | 5/1962 | Testa | 70/419 |
| 3,722,241 | 3/1973 | Sussina | 70/364 R |
| 3,837,197 | 9/1974 | Lopez | 70/364 A |
| 4,015,458 | 4/1977 | Mercurio | 70/419 |
| 4,227,387 | 10/1980 | Steinbach | 70/419 |

FOREIGN PATENT DOCUMENTS

| | | | |
|---|---|---|---|
| 247184 | 9/1963 | Australia | 70/364 A |

*Primary Examiner*—Robert L. Wolfe

*Attorney, Agent, or Firm*—Eisenman, Allsopp & Strack

[57] ABSTRACT

A cylinder lock wherein both cylinder and plug are radially bored to receive pin-pairs of specific design. A pin freeze element is positioned for movement within the plug in a direction substantially orthogonal to the axis of the plug bores. The interface between the pin freeze element and the pins includes incremental notches of matching configuration such that when the plug is turned, the pin freeze element engages the pins locking them from reciprocal movement. The mating surfaces of the pin freeze element and pins must be in registration for the plug to turn at all and they must be in perfect registration and properly aligned for the lock to open.

15 Claims, 9 Drawing Figures

IMPRESSION-RESISTANT LOCK

BACKGROUND OF THE INVENTION

1. Field of the Invention

This invention relates to cylinder locks and more particularly to cylinder locks which cannot be opened without a key by any of the known "lock-picking" techniques.

2. Description of the Prior Art

The inventor's U.S. Pat. No. 3,761,193, issued Oct. 2, 1973, discloses a cylinder lock having a plurality of pin assemblies selectively configured to engage a shoulder within the cylinder bore in the event that an attempt is made to pick the lock. Each pin assembly comprises a driver portion, a center portion, and a lower portion. The center and driver portions each contain unique transverse grooving which cooperates with the shoulder in the cylinder bore to prevent pin movement whenever rotational pressure is applied to the plug without first inserting the proper key.

This patent includes the basic components present in most cylinder locks: a key plug, a cylinder surrounding the key plug, a set of tumblers in the form of cylindrical pins mounted in radial bores in the key plug, and a set of driver pins mounted in radial bores in the cylinder corresponding to those in the key plug. When there is no key in the plug, the tumbler and driver bores are in alignment, and the driver pins project across the shear line between the cylinder and key plug into the tumbler bores in the plug, preventing it from being turned within the cylinder. In order to open such a lock, a key is inserted having indentations defining selective recesses and projections which cause each of the tumblers to be held to a definite lifted position such that the dividing line between the drivers and the tumblers in each bore coincides with the shear line between the cylinder and plug. When all pins are appropriately positioned, the plug is free to rotate.

There are two well-recognized techniques for picking conventional cylinder locks. In the first, the plug is forcibly turned relative to the cylinder, to the maximum extent allowed by the slight clearance between the pins and their respective bores. Whie maintaining torque upon the plug, each tumbler is carefully pushed upward so that the driver associated with it moves up into its bore in the cylinder until it comes to rest at the shear line due to the ledge created by the slightly rotated position of the plug. When all drivers have been pushed back into the cylinder bores in this manner, the plug can be freely turned and the lock opens.

In the second familiar technique, the tumblers and associated drivers are all initially pushed upward so that the tumblers enter the driver bores. The plug is then forcibly turned as far as it will go and the tumblers are allowed to drop under the action of the driver springs to their normal positions clear of the driver bores. This occurs because at the beginning of their downward movement, the tumblers are already partly within the plug. On the other hand, the drivers are not capable of following their tumblers because they will be stopped by the ledges that are created at the shear line due to the rotated position of the plug. Here again, the plug can be turned freely after all tumblers have dropped.

Another method of opening a lock for which one does not originally have a key, is the technique of "impressioning". In using this technique, a blank key is inserted into the plug and slight rotational pressure is applied during up and down movement of the key. When the key blank enters the lock it pushes all of the tumblers up into the driver bores and when plug pressure is applied, putting upper and lower bores out of register, these pins become trapped. Subsequently, when the key is raised, the pins being unable to move away, burnish small marks, or impressions, on the edge of the key. The key blank is withdrawn, the impressions lightly filed, and the key reinserted. During succeeding insertions, where filing has been done, the tumbler pins rest lower by a small amount. The process is repeated until one of the pins reaches it shear line. At this point, the pin is no longer trapped in a driver bore and becomes free-floating and incapable of making an impression on the key. This informs the impressionist that the pin is "open" and he simply continues with the procedure until all the remaining pins are open. The end result is a hand-filed key. A very undesirable feature of having a lock that can be breached by impressioning, is the fact that the lock can then be reopened at any future time leaving no clue of the opening.

In addition to the inventor's own work in this field, a large number of lock structures have been developed in an attempt to defeat the picking of locks by the above-described methods. The resulting structures, have included in various combinations the serration or grooving of the cylinder bores, the plug bores, the driver pins, and the tumbler pins. When transverse grooves are provided in the pins and bores, it will be understood that the pins cannot move freely except under prescribed conditions such as when their dividing lines are coincident with the shear line between the cylinder and the plug. This prevents a lock-picker from the simple application of the aforedescribed techniques. On the other hand, with a knowledge of the structure of such locks, a skilled lock-picker can generally "feel" or sense the relative positions of the driver and tumbler pins and given sufficient time will open all of these locks.

A series of locks that are quite effective in their ability to prevent illegal entry, are the Spain locks disclosed in U.S. Pat. Nos. 3,499,302, 3,499,303 and 3,722,240. These locks, in addition to other features, include tumblers in the key plug which must be positioned by a properly bitted key reciprocally to clear the shear line and also rotationally to allow a fence member to be cammed out of engagement with the cylinder shell. Only when the appropriate combination of translational and rotational position of each tumbler is effected, may the key plug be rotated.

SUMMARY OF THE INVENTION

The lock of the present invention is an improved form of cylinder lock wherein the cylinder bores, plug bores, pin structures, and a pin freeze element are each cooperatively designed to prevent forcing, sensing, or impressioning. In embodiments of this invention, all vital working areas can be protected with hardened steel shields to defeat illegal destruction by drilling.

It is an object of the present invention to provide an improved pick and impression-resistant cylinder lock.

It is another object of the invention to provide an improved cylinder lock utilizing pins having selectively disposed and uniquely designed transverse indentations along their surfaces.

Yet another object of the present invention is to provide an improved pick-resistant lock with a minimum of components that can be relatively easily manufactured.

Still another object of the invention is to provide an improved cylinder lock featuring the use of a pin freeze element having increments adapted to engage with corresponding increments on tumbler pins.

Yet another object of the invention is to provide an improved pick and impression-resistant cylinder lock having means to prevent the reading of the proper position of individual pins by means of wire.

Another object of the invention is to provide an improved lock wherein all pins are same-length matched pairs in order to prevent "reading" the spring pressure.

In accordance with a particular illustrative embodiment of the invention, there is provided a lock having cylinder and plug portions, each being radially bored to receive a plurality of pin-pairs of specific design. A pin freeze element is positioned for movement within the plug in a direction substantially orthogonal to the axis of the plug bores. This element is biased outwardly toward the surrounding cylinder. The interface between the pin freeze element and the tumbler pins includes incremental notches of matching configuration such that when the plug is turned, the freeze pin element engages the pins locking them from reciprocal movement.

In further accordance with the invention, the notches in the pin freeze element and tumbler pins must be in registration for the plug to turn at all and they must be perfectly registered and properly aligned for the lock to open. Inasmuch as turning the plug freezes the pins before they contact the respective bore, any attempt to take an impression of the pin positions is thwarted since the tumbler pins will always make impressions on a key blank independent of the fact that they may or may not be trapped in the driver bore.

The objects noted above, as well as further objects and numerous unique features of the invention, will be more fully understood and appreciated from the following detailed description which is made in conjunction with the drawings.

DETAILED DESCRIPTION OF THE PREFERRED EMBODIMENTS

Figure 1:
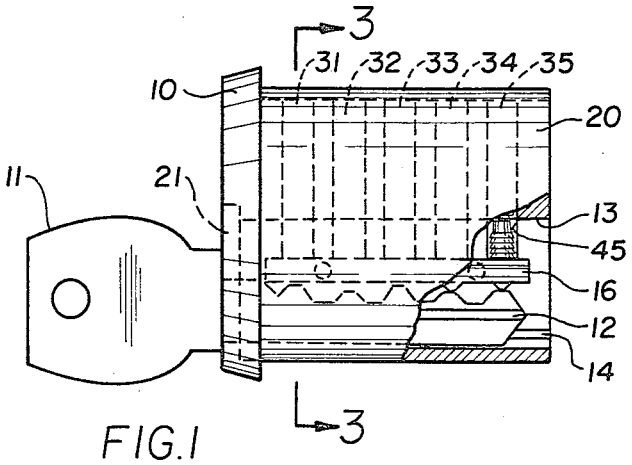
FIG. 1 is a side view, partially in cross-section, of a cylinder lock embodying the features of this invention.

The cylinder 10, shown in FIG. 1, is controlled by a typical key 11, having a shank 12 adapted for translation within a key slot 13. The configuration of the key conforms to axially aligned projections in the key slot, such as 14, and includes indentations of selected depth for correct radial positioning of the various pin assemblies. The cylinder lock includes a cylinder portion 20 and a plug portion 21 adapted for rotation therein. The cylinder portion contains a plurality of axially displaced radially disposed bores 31, 32, 33, 34, and 35. The plug portion includes a similar plurality of bores which are positioned for alignment with the cylinder bores when the lock is in its closed or rest position. The plug bores are designated 41, 42, 43, 44, and 45, respectively. Each pair of related bores in the cylinder and plug establish a radial chamber within which a pin-pair assembly operates. As explained hereinafter, each pin assembly is made up of two components comprising an upper driver pin and a lower tumbler pin.

Figure 2:
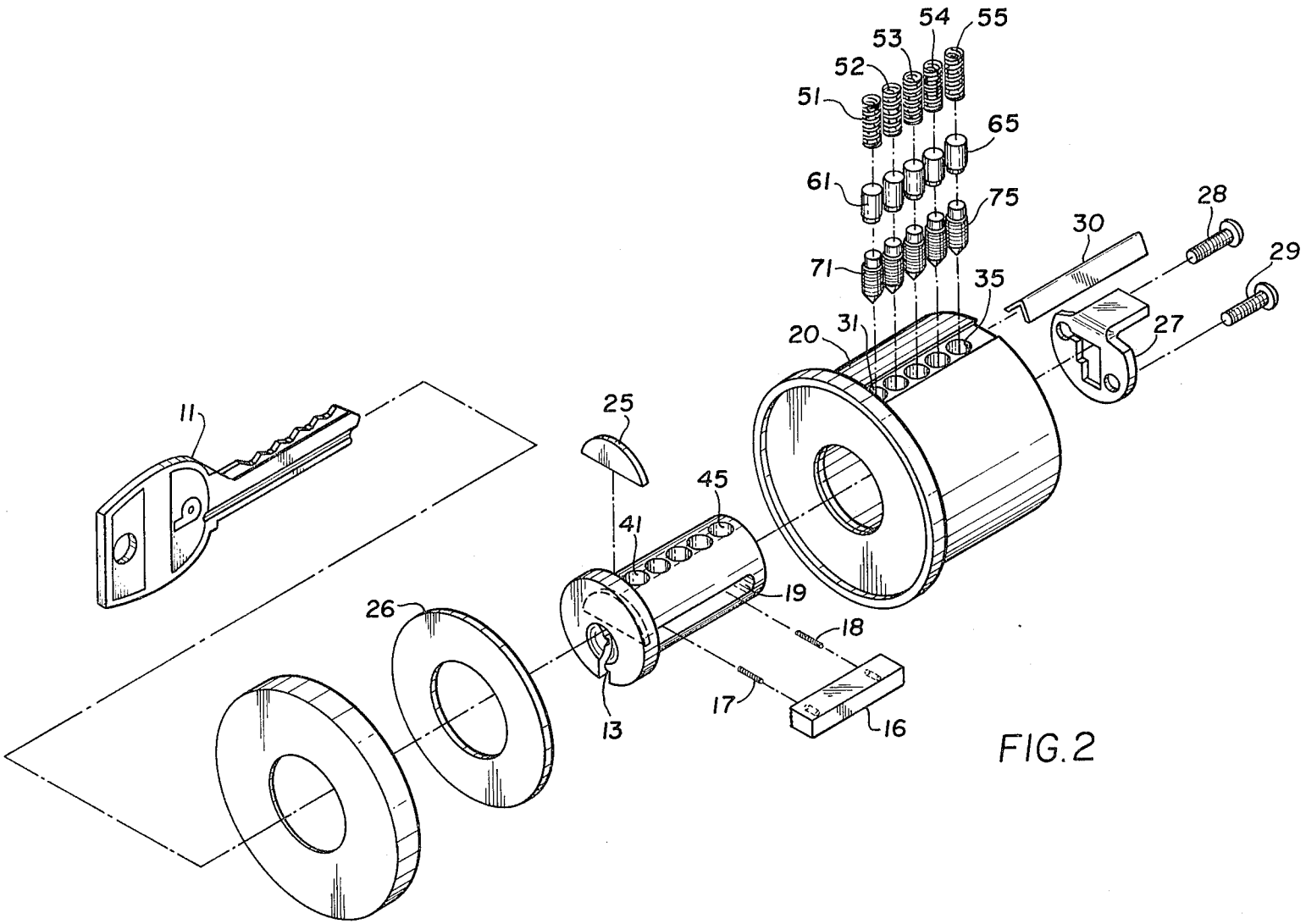
FIG. 2 is an exploded perspective view of the embodiment shown in FIG. 1.

FIG. 2 is an exploded view of the cylinder lock shown in FIG. 1. Throughout the drawings, like parts are designated by identical numerals. In addition to the basic components previously described, the exploded view of FIG. 2 shows five helical springs 51–55 arranged for positioning above driver pins 61–65 for biasing these pins and the lower tumbler pins 71–75 with which they are related, toward the center of the plug 21 and into the key slot 13. FIG. 2 also discloses pin freeze bar 16 and associated biasing springs 17, 18 adapted to rest within slot 19. The function of this bar and its interrelationship with the tumbler pins 71–75 will be described hereinafter.

While considering FIG. 2, reference should also be made to drill-resistant shield 25, and the protective drill-resistant steel plate 26 positioned in front of the cylinder and pin areas to afford protection against destruction of the lock by means of drilling. To the rear of the cylinder, trip plate 27 with fastening screws 28, 29 are shown. See also, the elongated angular cover plate 30 in exploded illustration from the groove above cylinder bores 31–35.

Figure 3:
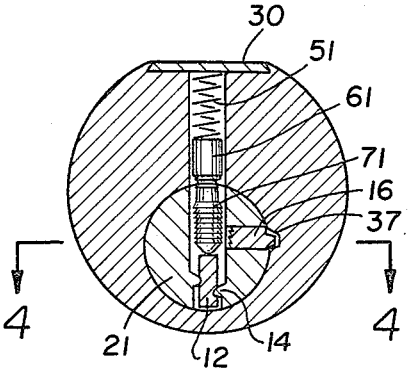
FIG. 3 is a cross-sectional view taken along the line 3—3 in FIG. 1, illustrating the position of typical pins when a key is inserted but the plug is not under rotational pressure.

The assembled condition of a typical pin assembly will be appreciated more fully by consideration of the cross-sectional view of FIG. 3 which is taken along the line 3—3 of FIG. 1. This is a transverse vertical section showing the plug rotationally aligned in a locked position within the cylinder when a key is initially inserted. Enlarged views of the relevant portion of this cross-section are presented in FIGS. 5 through 8 to show the principles in accordance with which this invention effects pick and impression-resistant characteristics.

In particular, FIG. 3 shows a driver pin 61 in contact with a tumbler pin 71 with which it is urged into contact by compressed helical spring 51. The key shank 12 rests within key slot 13 and presses the lower proximate portion of tumbler pin 71 upward to position the combined pin-pair assembly with the parting line between driver 61 and tumbler 71 at the shear line between plug 21 and cylinder 20. It will be appreciated that when all pin assemblies are similarly acted upon by an appropriate key 11, there will be no impedance against rotation of plug 21 and the lock can be opened. This presupposes that the side locking bar 16 is not forced outward into engagement with the slot 37 in the side of the cylinder.

Figure 4:
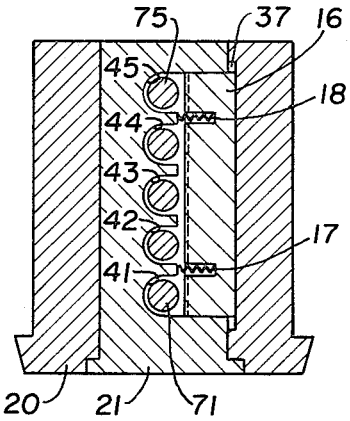
FIG. 4 is a cross-sectional view taken along the line 4—4 in FIG. 3, illustrating the location of six typical pins and a pin freeze element.

The cross-sectional view of FIG. 4 is taken along line 4—4 of FIG. 3 and shows the relative positions of the pin freeze bar 16, biasing springs 17, 18, and the tumbler bores 41–45 within plug 21.

Figure 5:
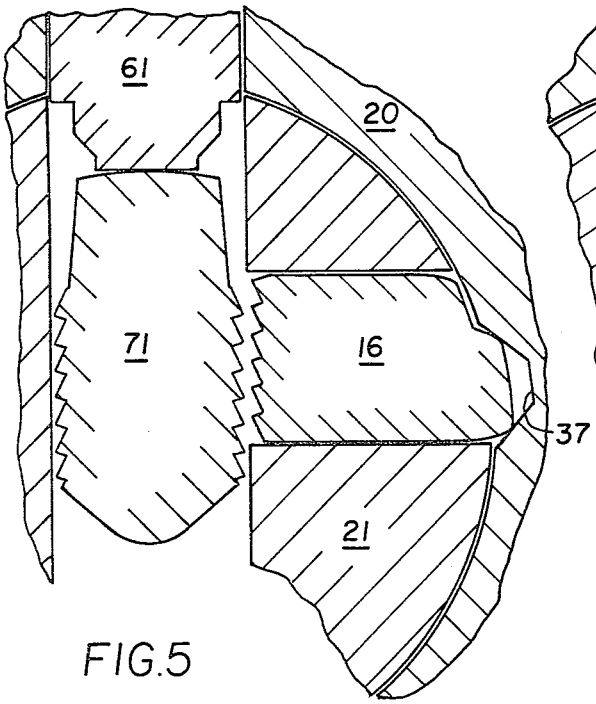
FIG. 5 is an enlarged cross-sectional view taken along the line 3—3 of FIG. 1 with the key removed, showing the pins down in locked position and the spring-operated pin freeze element in unlocked return position.

The enlarged view of FIG. 5 shows that when the cylinder is in its typical locked position, the drive pin 61 projects into the plug bore where it rests on the top of tumbler pin 71. The biasing effects of springs 17 and 18 press the pin freeze bar 16 into the slot 37 in the wall of the cylinder 20. Thus, any attempt to turn the cylinder meets with the opposition of drive pin 61 and the projecting portion of side locking bar 16. Similarly, depending only upon the relative lengths of the drive pins and tumbler pins in the other bores of the lock, the parting lines between these components will also block rotation until a proper key is inserted.

Figure 6:
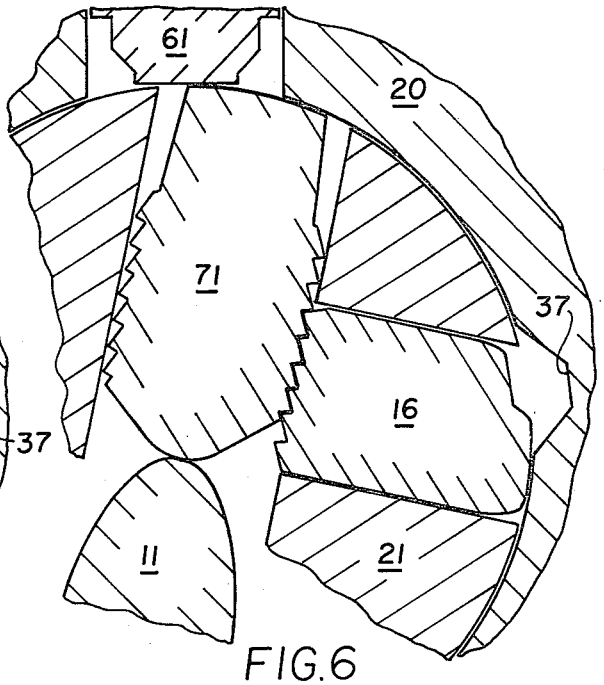
FIG. 6 is an enlarged cross-sectional view taken along the line 3—3 of FIG. 1 with a correct key inserted, showing the tumbler pin locked by the pin freeze element at the proper shear line.

The effect of inserting a proper key 11 is shown schematically in FIG. 6. In this instance, the tumbler pin 71 is pushed upward against the pressure of compressed spring 51 (not shown) which holds driver 61 in a downward position. Since the key is correct, the parting line between drive pin 61 and tumbler pin 71 is in alignment with the shear line between the plug and cylinder and rotation is permitted. Upon commencement of rotation, the pin freeze bar 16 rides up the lower inclined wall of slot 37 and in so doing is pressed inwardly against tumbler 71. The abutting faces of the pin freeze bar and each tumbler pin are selectively grooved and dimensioned for interlock. This can occur in a number of relative positions, one of which is when the parting line between the drive and tumbler pins corresponds with the shear line between the plug and cylinder. Thus, sufficient clearance is provided for the pin freeze bar to move inward within the circumference of the plug and provide no resistance to further rotation.

Attention is now directed to situations where unauthorized entry is attempted by a party who does not have the correct key. As explained above, the initial step in most lockpicking techniques is forced rotation of the plug relative to the cylinder. The manner in which these techniques are thwarted is shown schematically by FIGS. 7 and 8.

Figure 7:
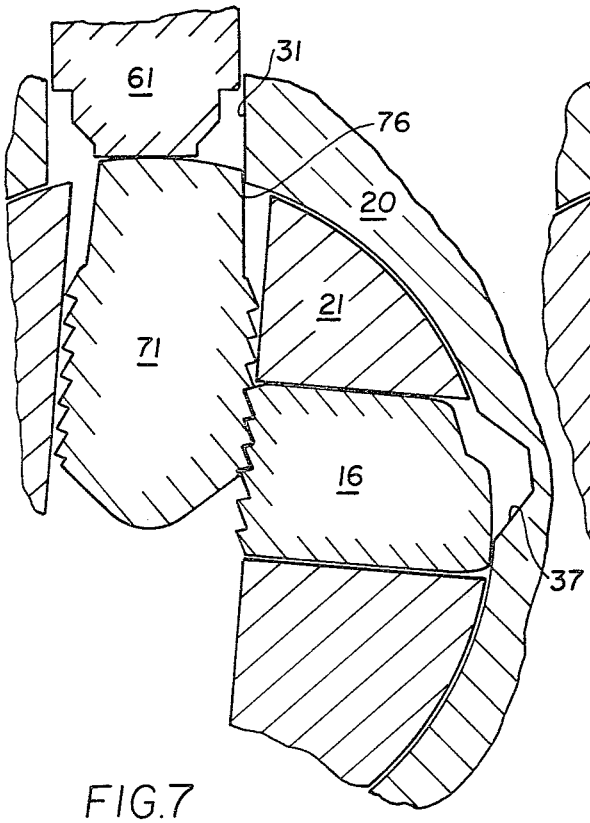
FIG. 7 is an enlarged cross-sectional view taken along the line 3—3 of FIG. 1 without a key inserted, during attempted picking with the plug forced into partial rotation in a clockwise direction, effecting locking of the tumbler pin within the upper bore where it is held by the pin freeze element.

In FIG. 7, the tumbler pin 71 has been improperly forced upward into the driver bore 31 of the cylinder. Drive pin 61 rests upon the crown of tumbler 71, but is of no effect because it is within the cylinder itself. When plug 21 is torqued in a clockwise direction, the upper shoulder 76 of tumbler 71 engages against the wall of the driver bore. In so doing, further rotational movement is prevented.

Simultaneously, the partial rotation of plug 21 moves pin freeze bar 16 into a position which forces it to ride up the lower wall of slot 37, moving it inward into engagement with the projections at the lower portion of tumbler 71. Once this engagement has occurred, it is not possible to effect further reciprocating movement of the tumbler pin within the plug bore. As a result, a lock picker is not able to sense how high the tumbler pin projects into the driver bore and will remain completely uninformed regarding the position or relative length of the tumbler 71 with respect to the driver 61.

Figure 8:
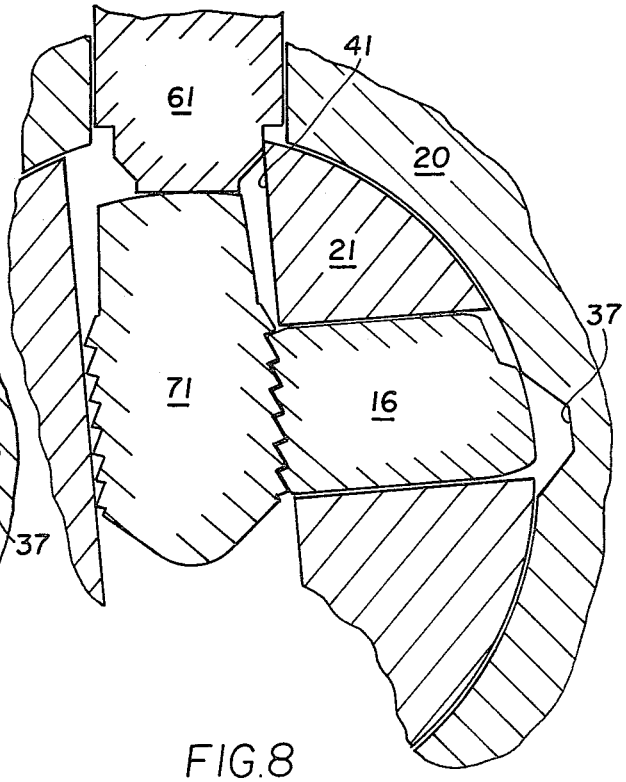
FIG. 8 is an enlarged cross-sectional view taken along the line 3—3 of FIG. 1 without a key inserted, during attempted picking with the plug forced into partial rotation in a counter-clockwise direction, effecting locking of the tumbler pin by the pin freeze element with the driver pin projecting into the plug bore.

FIG. 8 shows a contrasting condition when attempted picking is effected by means of counter-clockwise rotation of the plug when the driver 61 projects into the plug bore and rests upon the crown of tumbler 71. In this instance, further rotation of plug 21 is prevented by engagement of the upper edge of the plug bore 41 with the lower shoulder of drive pin 61. During the partial counter-clockwise rotation of the plug, FIG. 8 also illustrates that the distal end of the pin freeze bar has ridden up the upper slope of slot 37 and the bar is urged into interlocking contact with the mating surfaces of tumbler pin 71. Once again, further reciprocating motion of tumbler pin 71 is prevented and a lock picker cannot determine why or how this pin has become frozen in position. He is deprived of the potential knowledge regarding the length of the pin 71 vis a vis the driver 61, and whether or not the further rotation of the plug is prevented by the blocking action of the drivers or the tumblers.

Figure 9:
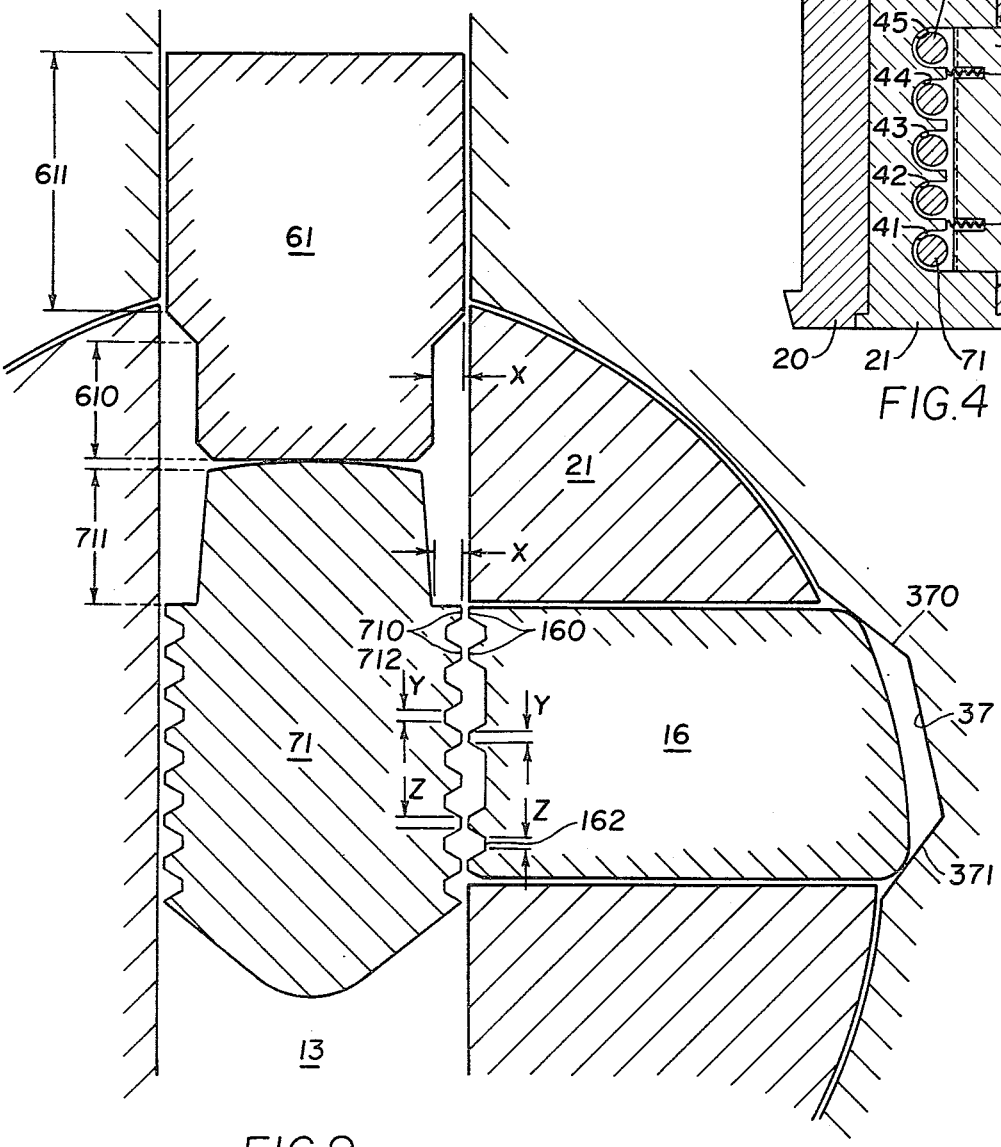
FIG. 9 is an enlarged cross-sectional view taken along the line 3—3 of FIG. 3, and showing a second embodiment of the invention having uniquely configured and mating grooves in the tumbler and pin freeze element.

With an understanding of the general principles of this invention, consideration is directed to FIG. 9 wherein a more explicitly dimensioned enlarged cross-sectional view is taken along the line 3—3 of FIG. 1 to show another embodiment. The plug 21 is shown in locked position with driver pin 61 projecting into the tumbler bore, tumbler pin 71 positioned midway within the plug bore, and side locking bar 16 unengaged with the tumbler pin.

First, it should be noted that the driver pin 61 and tumbler pin 71 are preferably dimensioned such that the distance from the top of driver 61 to the bottom tip of tumbler 71, for all pairs, is identical. This is effected by selectively modifying the length 610 of the driver pin shank while conversely modifying the length 711 of the tumbler pin shank. This will assure that each pin-pair within any lock will produce substantially the same overall travel and same overall "feel" when sensed from the bottom of a tumbler pin 71.

The grooves on tumbler 71 and mating projections of side locking bar 16 are each flattened. This assures that, in positions such as shown in FIG. 9, the pin freeze bar 16 is forced into broach 37 in the event the plug 21 is torqued in either direction. Thus, the plug is restrained from further movement not only by the interposition of either the driver or tumbler pins across the parting line of plug 21 and cylinder 20; but also by the fact that pin freeze bar 16 resides within the broached area and prevents rotation.

The angle of walls 370, 371 of the broach 37 is selectively determined with reference to the radius of the corners of pin freeze bar 16, in order to effect transverse movement of the locking bar by the distance "x" when the plug is turned a particular number of degrees either clockwise or counter-clockwise. This assures that any plug rotation while the nose portion 610 of driver pin 61 is in the plug bore, or when the upper portion 711 of tumbler 71 is in the cylinder bore, will permit the same amount of rotational motion and thereby thwart determination of the relative position of these pins within their bores. Of course, when no key is present, the larger diameter portion of the driver pin 61 will be within the plug bore under normal circumstances and no substantial plug rotation would be possible.

Attention is also directed to the slight taper of the upper portion 711 of tumbler pin 71. This taper is provided to yield parallel contact with the upper bore wall in cylinder 20 when the plug is rotated during attempted picking with the tumbler pin 71 residing in the upper bore. By maintaining the upper portion of all tumbler pins of similar taper, irrespective of length, all of the upper portions will contact their respective cylinder bore walls at substantially the same time during attempted picking, thereby preventing any clue regarding pin position based upon degree of plug rotation as various pins within a lock are manipulated.

As a final note regarding the illustration of FIG. 9, it will be seen that the squared peaks 160 of the pin freeze bar 16 are dimensioned "y" equivalent to the lower valleys 712 of tumbler pin 71. Conversely, the flattened peaks 710 of the tumbler pins are dimensioned "z" identically to the valleys 162 of the pin freeze bar.

The foregoing description has dealt both generally and specifically with lock component structures which function in combination to provide a cylinder lock that is difficult, if not impossible, to pick and which prevents effective impressioning. Modifications will be apparent to those skilled in the art. To the extent that such modifications are within the spirit and teaching of the invention and are embraced within the following claims, it is intended that they are covered by this invention.

What is claimed is:

1. A cylinder lock comprising a cylinder and a key plug mounted for rotation therein, a key slot in said plug and a radial plug bore extending from said key slot to the periphery of said plug, a radial cylinder bore extending within said cylinder and positioned for axial alignment with said plug bore in the locked state of said cylinder lock, driver and tumbler pins mounted for reciprocal movement within said bores, a pin freeze element mounted within said plug for reciprocating motion along an axis substantially orthogonal to and intersecting the axis of said plug bore, the adjacent surfaces of said tumbler pin and said pin freeze element being adapted to engage and prevenbt reciprocation of said tumbler pin, means biasing said pin freeze element out of engagement with said tumbler pin, and means for selectively engaging said pin freeze element and said tumbler pin when said key plug is rotated.

2. A cylinder lock as defined in claim 1, wherein the portion of said tumbler pin in proximity to said pin freeze element is grooved and corresponding grooves are provided in the confronting face of said pin freeze element.

3. A cylinder lock as defined in claim 2, wherein the peaks and valleys of said grooves are flattened and parallel to each other.

4. A cylinder lock as defined in claim 3, wherein the length of the flat on the tumbler pin peaks is equal to the length of the valleys between adjacent pin freeze element peaks.

5. A cylinder lock as defined in claim 2, wherein said pin freeze element is cammed towards said tumbler pin by said cylinder when said key plug is rotated.

6. A cylinder lock as defined in claim 5, wherein the distal end of said pin freeze element projects beyond the shear line between said key plug and said cylinder into a camming slot when said plug and cylinder bores are in substantial alignment and is cammed to a position within the periphery of said key plug when the plug is rotated with the parting line between the driver and tumbler pins along said shear line.

7. A cylinder lock as defined in claim 2, wherein the adjacent portions of said driver and tumbler pins are each of similar reduced diameter relative to the remote portions thereof.

8. A cylinder lock as defined in claim 7, wherein the difference between said reduced diameter and the outside diameter of said remote portions is substantially equal to the reciprocating motion of said pin freeze element.

9. A cylinder lock as defined in claim 7, wherein the portion of said tumbler pin adjacent to said driver pin is tapered slightly inwardly toward the end.

10. A cylinder lock as defined in claim 1, wherein the parting line between the driver and tumbler pins falls at the shear line between said key plug and cylinder and said pin freeze element engages said tumbler pin when the proper key is inserted and the key plug is rotated.

11. A cylinder lock as defined in claim 1, comprising a plurality of cylinder bores, plug bores, and driver-tumbler pin pairs.

12. A cylinder lock as defined in claim 11, wherein the total length of each driver-tumbler pin pair, when the driver and tumbler pins are in contact, is equal and wherein the relative length of the driver and tumbler pins within each pair differs.

13. A cylinder lock comprising a cylinder and a key plug mounted for rotation therein, a key slot in said plug and a radial plug bore extending from said key slot to the periphery of said plug, a radial cylinder bore extending within said cylinder and positioned for axial alignment with said plug bore in the locked state of said cylinder lock, driver and tumbler pins mounted for reciprocal movement within said bores, a pin freeze element mounted within said plug for reciprocating motion along an axis substantially orthogonal to and intersecting the axis of said plug bore, means for selectively engaging said pin freeze element and said tumbler pin when said key plug is rotated, the lower portion of said tumbler pin and the proximate portion of said pin freeze element being provided with cooperating grooves, said pin freeze element being biased away from said tumbler pin and projecting into a camming slot in said cylinder, the grooves in said tumbler pin and said pin freeze element being adapted to engage whenever said key plug is rotated, the respective lengths of said driver and tumbler pins being selected to position the parting line therebetween along the shear line between the key plug and cylinder when a proper key is inserted in said key slot.

14. A cylinder lock as defined in claim 13, comprising a plurality of cylinder bores, plug bores, and driver-tumbler pin pairs.

15. A cylinder lock as defined in claim 13, wherein the total length of each driver-tumbler pin pair, when the driver and tumbler pins are in contact, is equal and wherein the relative length of the driver and tumbler pins within each pair differs.

* * * * *